United States Patent [19]

Previsani

[11] Patent Number: 4,584,210

[45] Date of Patent: Apr. 22, 1986

[54] METHOD AND MEANS FOR PRODUCING WATERPROOFING MEMBRANES

[75] Inventor: Mario Previsani, Vascigliano di Stroncone, Italy

[73] Assignee: U.S. Intec Inc., Port Arthur, Tex.

[21] Appl. No.: 656,514

[22] Filed: Oct. 1, 1984

[51] Int. Cl.[4] ..... B05D 1/18; B05D 1/36; B05D 3/02

[52] U.S. Cl. ..... 427/204; 427/389.8; 427/393.5; 427/398.3; 427/443

[58] Field of Search ..... 427/365, 366, 389.9, 427/398.3, 442, 443, 204, 205, 389.8, 393.5

[56] References Cited

U.S. PATENT DOCUMENTS

| | | | |
|---|---|---|---|
| 1,968,246 | 7/1934 | Coleman | 20/7 |
| 3,967,032 | 6/1976 | Plotz et al. | 428/300 |
| 4,035,544 | 7/1977 | Iwasaki et al. | 428/291 |
| 4,091,135 | 5/1978 | Tajima et al. | 428/40 |
| 4,274,901 | 6/1981 | Elber | 156/242 |
| 4,368,228 | 1/1983 | Gorgati | 428/110 |
| 4,457,983 | 7/1984 | Maile et al. | 428/213 |

*Primary Examiner*—Michael R. Lusignan
*Attorney, Agent, or Firm*—Arnold, White & Durkee

[57] ABSTRACT

A method of producing waterproofing membranes is disclosed. A tough, fibrous web or matting is saturated with a thermoplastic waterproofing compound to produce a predetermined minimum thickness on both the upper and lower surfaces of the membrane sufficient to provide adequate flow characteristics during installation of the membrane without excessive exposure of the support matting to deteriorating conditions during installation. Afterwards the coated membrane is cooled and inverted for further treating at least one of the exposed surfaces with additional material.

10 Claims, 5 Drawing Figures

METHOD AND MEANS FOR PRODUCING WATERPROOFING MEMBRANES

BACKGROUND OF THE INVENTION

The invention relates generally to protective materials and more particularly to water repellant, i.e., waterproofing, membranes which may be applied to the outside of structures, for example, roofs to secure the interior from rain damage.

Waterproofing membranes can be used in any application where it is desirable to protect a substrate from water. For example, waterproofing membranes can be used in water tanks, canals, foundations, patios, landfills and the like. A major use of waterproofing membranes is in the roofing industry. Waterproofing membrane type roofing, also known as single ply roofing, is typically used in construction where roofing structures will accommodate nothing heavier than a single ply installation.

Waterproofing membranes, as typically manufactured, consist of a web of tough, fibrous matting usually of polyester or fiberglass, which is saturated with a waterproofing coating of thermoplastic bituminous material. The process generally consists of saturating the matting with a heated bituminous waterproofing compound in a vat, then immediately cooling and solidifying the bituminous compound in water. This results in a waterproofing membrane having a thick upper surface of waterproofing compound and a thin lower surface of waterproofing compound, i.e., the matting is positioned closer to the lower surface of the membrane. Typically, the upper surface of the membrane is covered with a material such as aluminum sheeting or sand to cover surface defects in the membrane surface and to protect the membrane, for example, from UV radiation which can deteriorate the membrane.

Waterproofing membranes are typically attached to a substrate by heating the membrane, for example, by torch, so as to cause the waterproofing component of the membrane to become slightly molten and flow to bond the membrane to a substrate. In a typical application procedure, the exposed underside of a rolled-up membrane is heated by torch and then unrolled onto the substrate.

However, because of the prior manufacturing techniques employed in producing waterproofing membranes of this type several disadvantages result. A major disadvantage is the difficulty in locating the matting in a pre-determined position within the membrane. As noted, in prior manufacturing methods the matting is located closer to the lower surface of the membrane. Additionally, only the upper surface of the membrane is treated with protective materials. This results in producing a membrane having the protective materials on the thick side of the membrane. Consequently, when the waterproofing membrane is installed, the thin lower surface closest to the matting must be heated. As a result, when the waterproofing membrane is applied to a substrate, the heating can damage the inner matting thus compromising the waterproofing integrity of the membrane. In addition, less waterproofing compound is available for bonding to the substrate and additional thermoplastic material may have to be applied to complete the bond.

Other manufacturing disadvantages in the waterproofing membrane industry are the presence of holes, blisters, and craters, generally on the lower surface of the membrane, due to the explosion of air or moisture bubbles in the matting, thus increasing the chances of compromising the waterproofing integrity of the membrane. This results from moisture inherent in the matting forming bubbles when subjected to the heat of the waterproofing compound, typically at temperatures of about 190° C. If the bubbles do not explode, blisters remain in the membrane. If they explode, holes and craters appear. In addition, production speed must be low in order to cool membranes sufficiently for further processing and storage, especially where the finished membranes approach thicknesses of 4 and 5 millimeters. Consequently, it has been virtually impossible to produce modified membranes in a single processing with times and costs comparable to the production of plain, i.e., non-coated, membranes. Additionally, residual moisture which remains after cooling can be entrapped by additional layers of material applied to the membrane. As a result, separation can occur between the membrane and the applied material. This is especially critical where residual moisture retained by the membrane can cause overlapping seams of the installed membrane to separate.

Because of the disadvantages inherent in prior waterproofing membrane manufacturing methods, an improved process is desired.

SUMMARY OF THE INVENTION

The present invention is a unique method of constructing a waterproofing membrane wherein the inner matting can be located in the waterproofing membrane in a pre-determined position. A suitable matting material is introduced into a heated viscous waterproofing compound. The matting material is saturated with the compound and then passed through sizing rollers to provide a membrane of a desired thickness. The material is then cooled in a water medium and then in a air medium wherein the residence time of the material in each medium is determined by the physical characteristics of the material and the ambient temperature. The membrane is then inverted and coated with a second coating of waterproofing compound, adhesives, or protective materials.

Advantageously, by inverting the membrane, protective material can be applied to the thin side of the membrane. Therefore, the membrane can be installed by heating the thick side of the membrane which is the farthest from the matting. As a result, the matting is afforded greater protection from heat damage and more waterproofing compound is available for bonding the membrane to a substrate. Moreover, it has been observed that since protective coatings, such as mineral chips, are applied to the surface closest to the matting, the protective coatings are provided more support from the matting rather than partially sinking into the thick waterproofing compound.

A further advantage of this method is that by controlling the depth of submersion of the matting in the heated waterproofing compound, surface holes, craters and blisters can be reduced. Additionally, since coatings and protective materials can be applied in two distinct stages, each followed by a cooling stage, processing times for modified membranes can be reduced. Moreover, by splitting each cooling stage into a water medium and an air medium with the ability to vary the residence time in each medium, cooling time can be adjusted to the type of membrane being processed, e.g., the thickness of the membrane, the temperature of the compound applied, the ambient temperature, and the production speed.

A further advantage of this method is that by cooling the membrane in an air medium, the residual heat of the membrane serves to remove sufficient amounts of moisture from the membrane to significantly reduce incidents of separation of materials from the membrane during torch applications.

DETAILED DESCRIPTION OF THE INVENTION AND PREFERRED EMBODIMENTS

Materials:

The process of the invention employs saturating a tough, fibrous web or matting with a waterproofing compound. Any matting capable of being saturated with the waterproofing compound can be employed in the process. A preferred embodiment of the invention employs fiberglass or nonwoven polyester as the matting. The nonwoven polyester has the ability to stretch and elongate and therefore is preferable in climates having wide variations in temperature.

The waterproofing compound can be any appropriate thermoplastic substance capable of saturating the matting. In a preferred embodiment of the invention a blend of bitumen and atactic polypropylene is used. Bitumen is the primary constituent of asphalt and is a mixture of various hydrocarbons. Asphalt is a dark brown to black generally viscous cementitious material which can occur in nature but is more commonly obtained as a residue from oil refining. Atactic polypropylene is an amorphous, non-crystalline compound which is generally a discarded by-product. In a preferred embodiment of the process several forms of the amorphous polypropylene are used in the mixture to avoid brittleness in the final product.

The atactic polypropylene and bitumen are mixed and cooked to provide the blended compound used in impregnating the matting. The ratio of atactic polypropylene to bitumen is determined by using ASTM procedures to check the atactic polypropylene and bitumen for certain physical properties including viscosity, penetration, softening point and flexibility. Additionally, the asphalt is checked for flash point. The determination of these characteristics provide a basis for determining a blend ratio which will give a sufficient viscosity range for a certain temperature. If the viscosity is too low, the matting will not hold the compound, and if the viscosity is too high, the compound will not impregnate the matting. After the atactic polypropylene and the bitumen have been mixed, they are cooked typically at about 220° centigrade for several hours to produce a more uniform blend and then placed into a holding tank prior to use.

Figure 2:
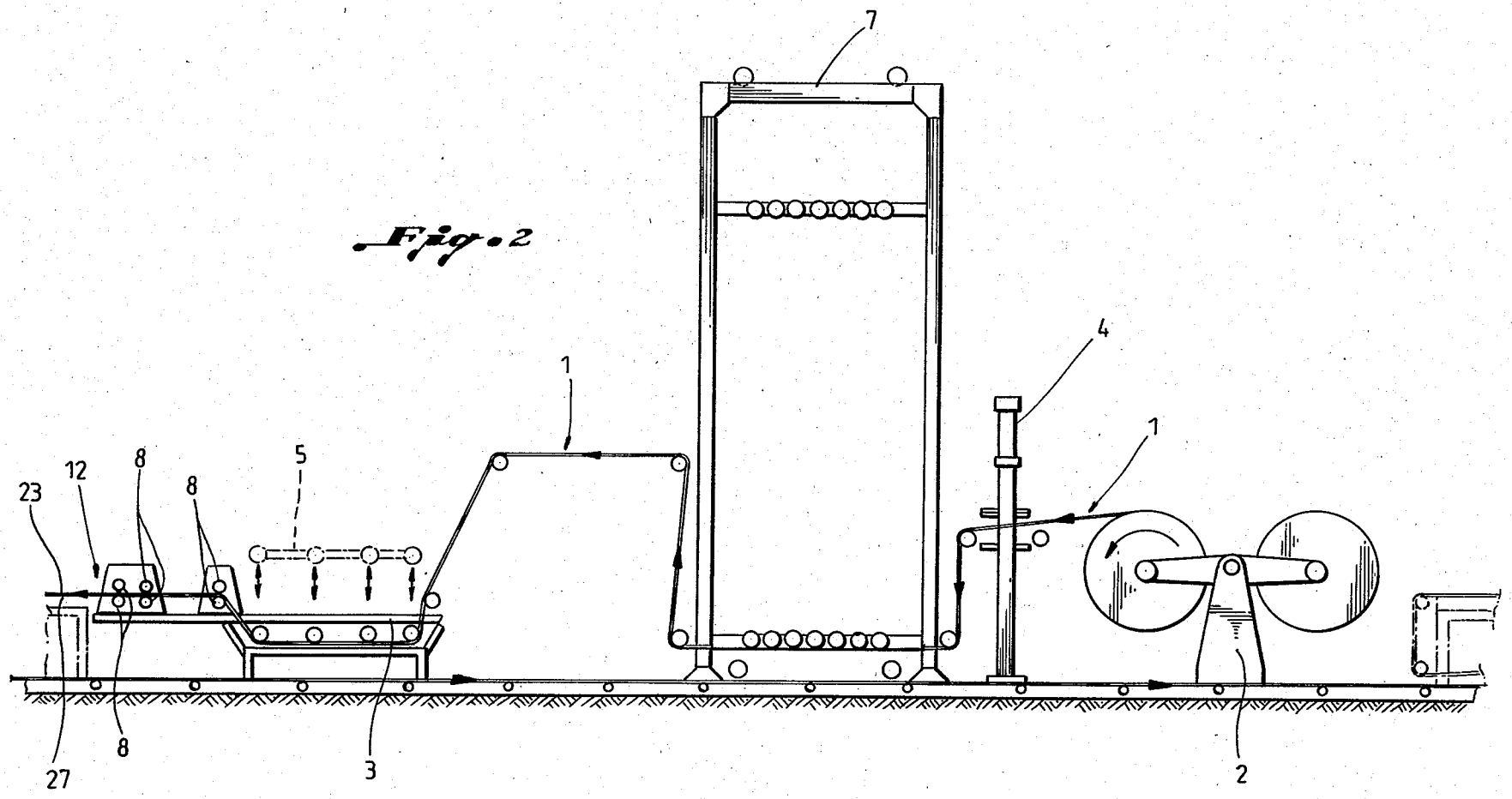
FIG. 2 is a drawing depicting the beginning of the process, the saturation stage and the sizing stage.

The Process:

Referring to FIG. 2 the process begins by feeding matting 1, stored in rolls, from an unwinder 2 to a saturation vat 3 containing a waterproofing compound. The splicing table 4, and an accumulator 7 are also depicted. The mobile carriage 5 serves to hold the matting material in the saturation vat 3. The mobile carriage can hold the matting in the saturation vat at any desired level, i.e., totally submerged or at a level sufficient to contact only one side of the matting. In the preferred embodiment of the invention, the matting is submerged in the saturation vat in order to completely saturate the matting. By minimizing the depth at which total saturation will occur, surface defects, which typically occur on the lower surface of the membrane, can be reduced. This appears to be due to the ability of moisture and air bubbles inherent in the matting to more easily surface from a shallower depth.

After exiting the saturation vat, the matting is conveyed to a series of sizing rollers 8. Each sizing roller consists of an upper roller and a lower roller. The distance between the upper and lower rollers is adjustable and determines the thickness of the product which exits the rollers. The rollers rotate opposite to the direction of travel of the saturated matting thereby removing excess compound from the product and allowing at least a portion of the excess compound to flow back into the saturation vat. The product exiting the sizing rollers is hereinafter referred to as a membrane 12. The rollers are heated to prevent the compound from adhering to the rollers. In this embodiment, the preliminary membrane exiting the sizing rollers will have an upper surface 23 with a thicker coating of compound and a lower surface 27 with a thinner coating of compound.

Figure 1:
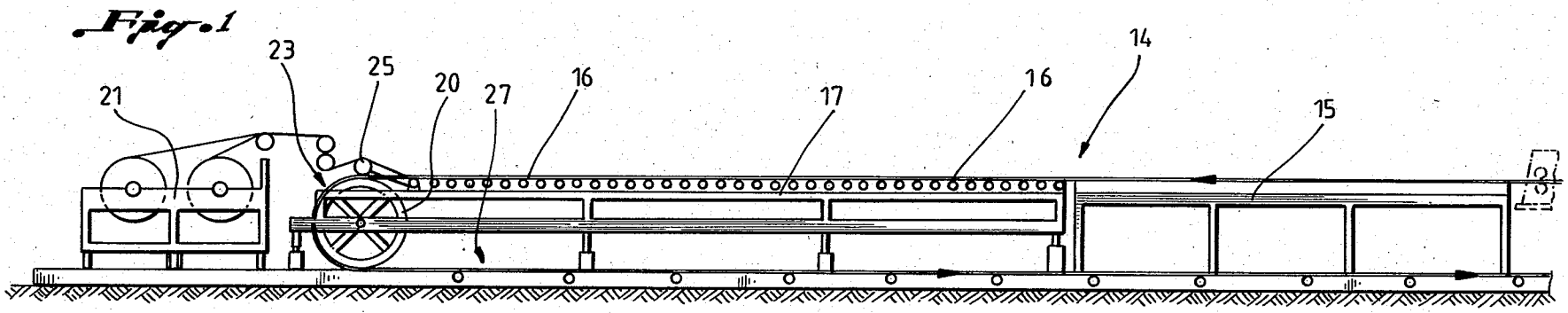
FIG. 1 is a drawing depicting the cooling and air drying stage and one point where material can be applied to a surface of the membrane.

Referring to FIG. 1, after exiting the sizing rollers 8, the membrane enters a cooling stage generally depicted at 14. The cooling stage 14 consists of a water cooling vat 15 and a second water cooling vat 17 including a series of vertically adjustable rollers 16. Immediately upon exiting the sizing rollers 8, the membrane enters the cooling vat 15 where it is contacted with the surface of the water causing the waterproofing compound to begin to harden. After an initial cooling in vat 15, the membrane is conveyed to a series of adjustable rollers 16. The membrane can be further contacted with the water in cooling vat 17 for the purpose of cooling by adjusting a portion of the sequence of rollers 16 downward. Once sufficiently cooled with water, the membrane can be elevated by adjusting a portion of rollers 16 upward so that the membrane is out of contact with the water wherein the residual heat of the membrane serves to remove further moisture and provide additional cooling. The residence time of the membrane in the water cooling vat and in the air cooling stage can be varied by making the desired vertical adjustments to the series of rollers 16. This allows the cooling stage to be modified to accommodate the various physical characteristics of the membranes being procesed, e.g., the membrane thickness and the temperature of the compound. In addition, the cooling stage can be adjusted for various production speeds and the ambient temperature.

After cooling, a cylinder 20 inverts the membrane such that membrane surface 23 (thick side) becomes the lower surface and membrane surface 27 (thin side) becomes the upper surface. In this embodiment, by inverting the membrane, a protective coating can be applied to the thin side of the membrane closest to the matting, rather than applying the protective coating to the thick side of the matting as in conventional processes that work on only one surface of the membrane. Thus, when installing the waterproofing membrane on a substrate, the thick side of the membrane can be heated, therefore greatly reducing the possibility of damaging the matting.

Figure 3:
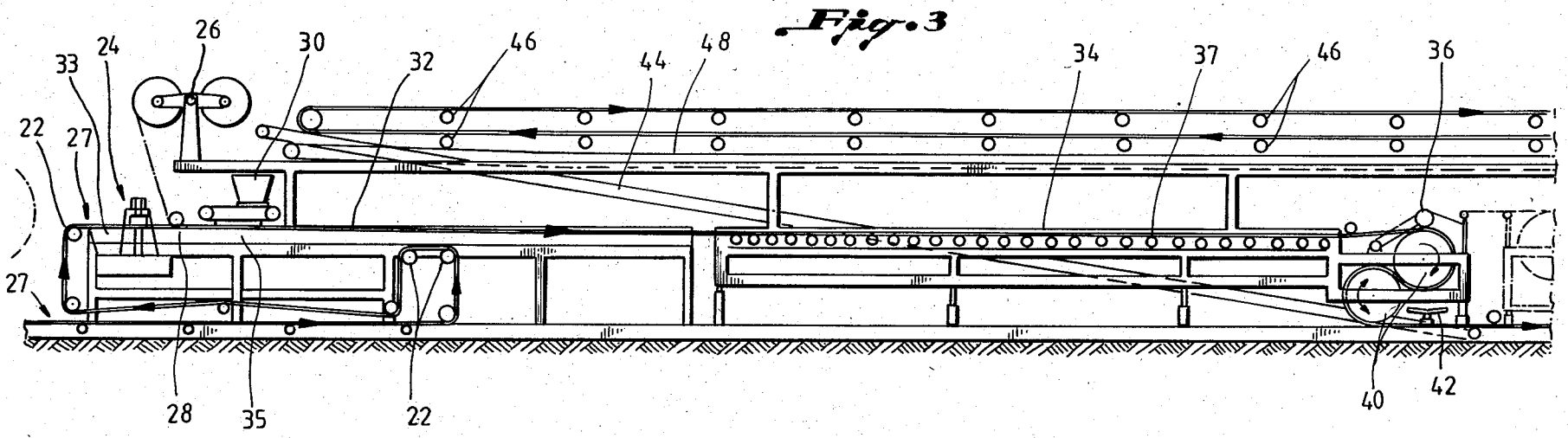
FIG. 3 is a drawing depicting the application of material to the opposite surface of the membrane, cooling and air drying stages and a point where material can be applied to a surface of the membrane.

Referring to FIG. 3, a series of rollers 22 assist in orienting the membrane so as to have the membrane surface 27 (thin side) on top for further processing. The membrane is conveyed through heated sizing rollers 24, which in this embodiment makes the membrane surface 27 sufficiently tacky to bond a coating of protective material. Material can be supplied from unwinder 26 and embossed on the membrane surface 27 by calender 28. This material can be any suitable material, including but not limited to, copper, aluminum, film such as polypropylene film, felts such as felts of polyester, asphalt saturated sheeting or fiberglass insulation. If desired, material provided from unwinder 26 can be omitted, and any suitable granular material, including but not limited to sand and mineral chips, can be deposited on membrane surface 27 from hopper 30. The material applied serves various functions, for example, protecting the matting on the thin side of the membrane, and reflecting harmful UV radiation which can deteriorate the membrane.

The membrane is then conveyed to a water cooling vat 32. A sliding plane 35 supports the increased weight of the membrane caused from material applications until conveyed to a second water cooling vat 34 which includes a series of adjustable rollers 37 which function the same as rollers 16 in that they can be adjusted to vary the residence time of the membrane in the water medium and in the air medium. If desired, an additional layer of material can be applied to membrane surface 27 from unwinder 31 (FIG. 4) and embossed, if needed, by calender 36. For example, an aluminum sheeting can be applied to a layer of insulation, or plastic sheeting can be placed over granule-covered membranes to retain loose granules.

If granular material is deposited, cylinders 40 orient the material so that excess granular matter is deposited in tray 42. Excess granules are taken by conveyor 44 and re-deposited in hopper 30 for further use in granularly coating the membrane.

Figure 5:
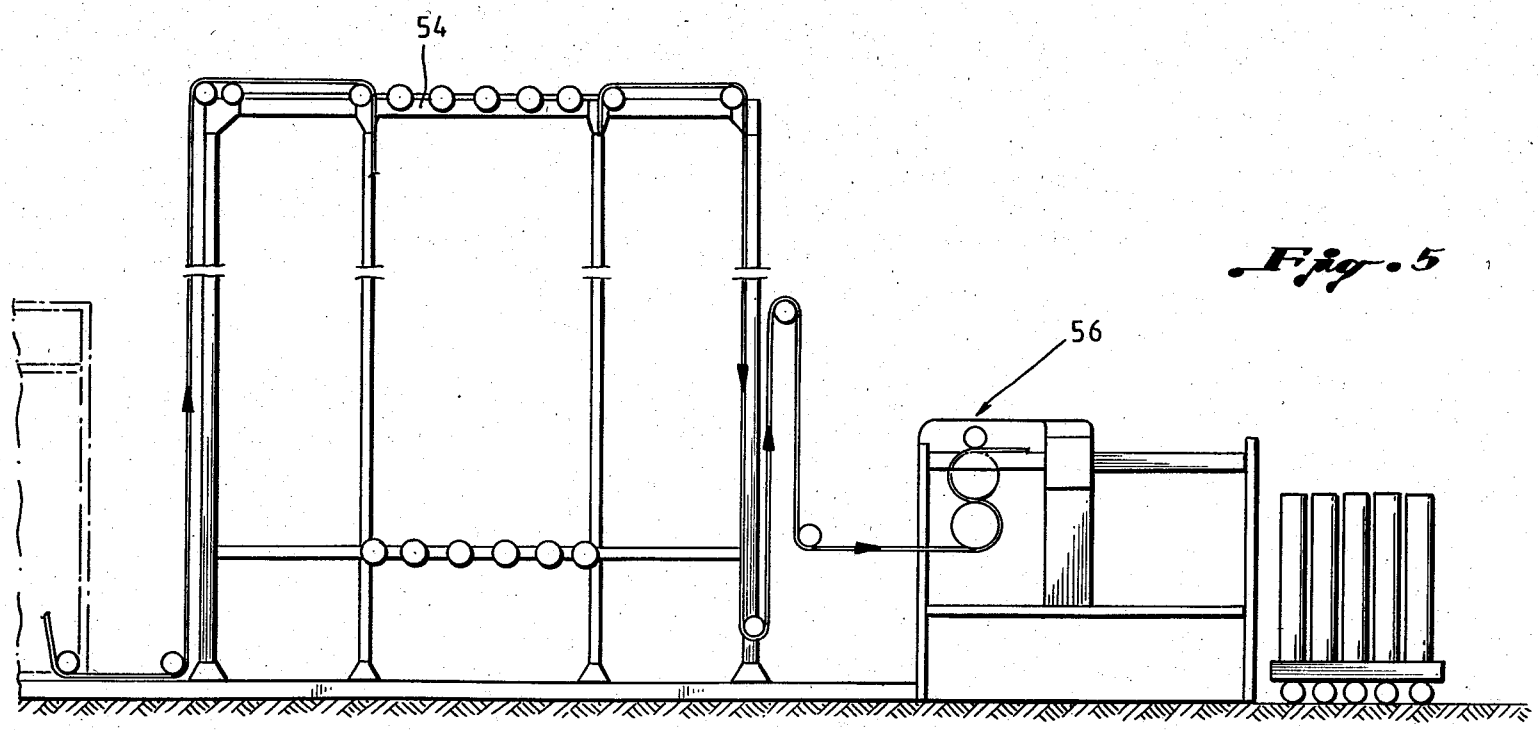
FIG. 5 is a drawing depicting the accumulator and termination point of the process.
Figure 4:
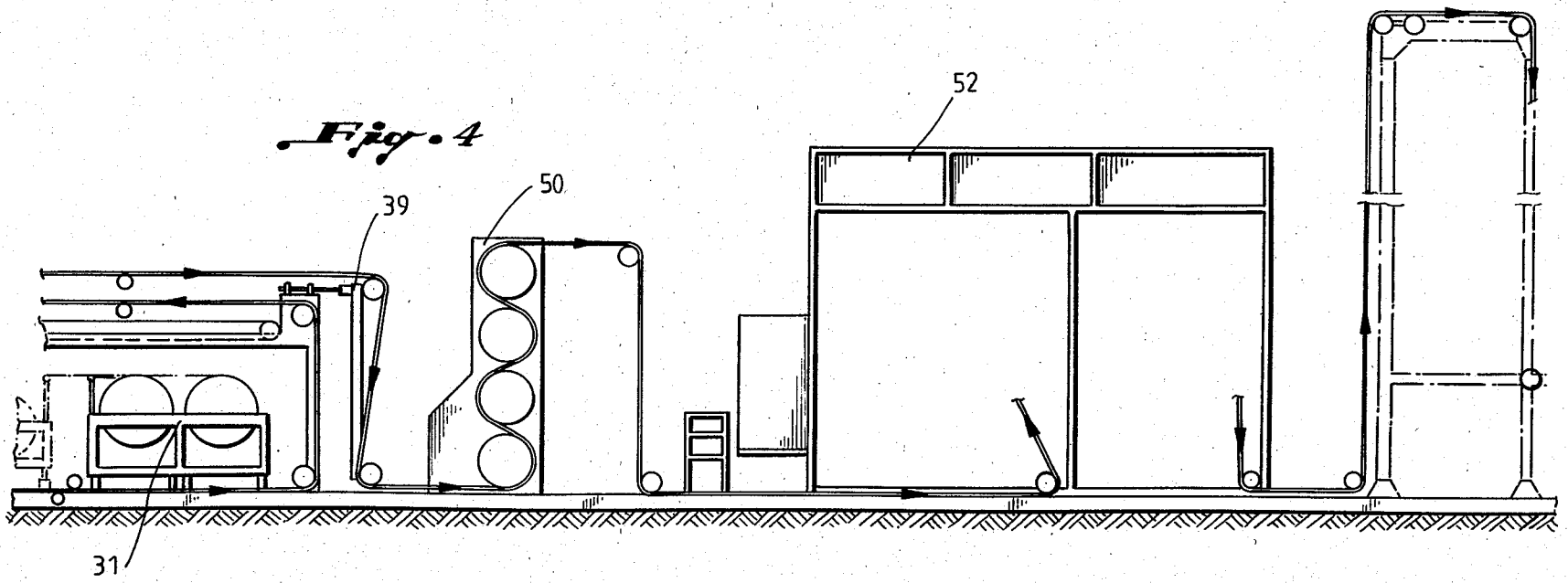
FIG. 4 is a drawing depicting the drive motors and the talc room.

Referring to FIGS. 3 and 4, the membrane is conveyed back and forth across rollers 46 to further cool the membrane before preparing the membrane for storage. Further excess granules are recovered by conveyor 48 which re-deposits the granules in hopper 30. The membrane is conveyed through drive motors 50 to a talc room 52 where talc is applied to the finished material to prevent excessive sticking of the material while rolled for storage. Referring to FIGS. 4 and 5, the membrane is conveyed through an accumulator 54, and rolled into rolls for storage at stage 56. Band guides, for example at 39, keep the membrane positioned to accept additional layers of material in a linear fashion.

Although a particular embodiment of the present invention has been discussed and illustrated above, numerous modifications and alternative embodiments of the method of this invention will be obvious to those skilled in the art in view of this description. For example, the sizing rollers 8 can be adjusted to provide some positioning of the matting within the membrane. The sizing rollers, for example, can be further adjusted vertically to provide less support to the saturated matting passing through them, thereby allowing gravity to cause more of the compound to flow to or remain on the lower side of the matting. By adjusting the sizing rollers to provide positive support to the saturated matting, more compound can be retained on the upper surface of the membrane. Moreover, a second heated vat 33 (FIG. 3) containing additional waterproofing compound can be used for increasing the final thickness of the membrane, covering surface defects, or as an adhesive for other material applications. In this instance, sizing rollers 24 would determine the final size of the membrane the same as sizing rollers 8. If desired, vat 33 can contain adhesives for the specific application of, for example, sheets, fabrics, protective material such as copper, aluminum, knurled aluminum, craft sheets, film, fiberglass, polyester, sand, mineral chips, or insulating materials. Additionally, material can be supplied from unwinder 21 (FIG. 1) and embossed on membrane surface 23 by calendar 25. For example, a protective film of polypropylene film can be applied which can later be burned-off during the installation of the membrane on a substrate. It is also recognized that application of material to the membrane surfaces can be omitted, thus producing a "plain" membrane. Thus, it will be recognizable to those skilled in the art that various membrane "sandwiches" can be constructed using the method of this invention. Accordingly, this description is to be construed as illustrative only and is provided for the purpose of teaching those skilled in the art the manner of employing the method of the present invention.

What is claimed is:

1. In the process of producing a waterproofing membrane by saturating a suitable support matting with a thermoplastic bituminous material, the improvement whereby a membrane is produced with the support matting situated in the membrane at a predetermined position such that its integrity is protected during installation without the need for excess thermoplastic material, which comprises the steps of:

(a) saturating the matting with a thermoplastic material to produce a predetermined minimum thickness on both the upper and lower surfaces of the membrane sufficient to provide adequate flow characteristics during installation of the membrane without excessive exposure of the support matting to deteriorating conditions during installation;

(b) cooling the thus-coated membrane such that substantially all of the thermoplastic material hardens above its flow temperature;

(c) inverting the membrane after cooling; and (d) treating the surface of said membrane which had been the lower surface of said membrane prior to said inversion by adding at least one additional layer of material to said membrane surface.

2. The method of claim 1 wherein the support matting is selected from the group consisting of nonwoven polyester and fiberglass.

3. The method of claim 1 wherein the thermoplastic material is a blend of bituminous material and atactic polypropylene.

4. The method of claim 1 wherein said cooling further comprises cooling in a water medium and in an air medium wherein the residence time of the membrane in each medium can be adjusted.

5. The method of claim 1 wherein said exposed surfaces are treated by applying additional thermoplastic material which provide newly exposed surfaces for treatment.

6. The method of claim 1 wherein said exposed surfaces are treated by applying adhesives which provide newly exposed surfaces for treatment.

7. The method of claims 1, 5 or 6 wherein the surface of said membrane which had been the lower surface of said membrane prior to said inversion is treated by applying protective materials.

8. The method of claims 1, 5 or 6 wherein the surface of said membrane which had been the lower surface of said membrane prior to said inversion is treated by applying materials selected from the group consisting of copper, aluminum, polypropylene, polyester, felt, fiberglass, asphalt saturated sheeting and plastic film.

9. The method of claims 1, 5 or 6 wherein the surface of said membrane which had been the lower surface of said membrane prior to said inversion is treated by applying granular material selected from the group consisting of sand and mineral chips.

10. The method of claim 1 further comprising cooling the treated membrane in a cooling stage comprising a water medium and an air medium wherein the residence time of the membrane in each medium can be adjusted.

* * * * *